US010292464B2

(12) United States Patent
Modi

(10) Patent No.: US 10,292,464 B2
(45) Date of Patent: May 21, 2019

(54) EXPANDABLE BANGLE BRACELET

(71) Applicant: FIRESTAR DIAMOND, INC., New York, NY (US)

(72) Inventor: Nirav Modi, Mumbai (IN)

(73) Assignee: FIRESTAR DIAMOND, INC., New York, NY (US)

( * ) Notice: Subject to any disclaimer, the term of this patent is extended or adjusted under 35 U.S.C. 154(b) by 0 days.

(21) Appl. No.: 15/574,372

(22) PCT Filed: May 4, 2016

(86) PCT No.: PCT/US2016/030768
§ 371 (c)(1),
(2) Date: Nov. 15, 2017

(87) PCT Pub. No.: WO2016/182816
PCT Pub. Date: Nov. 17, 2016

(65) Prior Publication Data

US 2018/0132575 A1 May 17, 2018

Related U.S. Application Data

(60) Provisional application No. 62/161,151, filed on May 13, 2015.

(51) Int. Cl.
*A44C 27/00* (2006.01)
*A44C 5/04* (2006.01)
*A44C 5/00* (2006.01)

(52) U.S. Cl.
CPC ..... *A44C 5/0069* (2013.01)

(58) Field of Classification Search
CPC ..... A44C 5/0069; A44C 5/0076; A44C 5/04; A44C 5/06; A44C 5/08; A44C 9/02; A44C 27/00
USPC ..... 63/5.1, 6
See application file for complete search history.

(56) References Cited

U.S. PATENT DOCUMENTS

| | | | | |
|---|---|---|---|---|
| 4,733,544 | A | 3/1988 | Londaro | |
| 7,472,564 | B2 | 1/2009 | Bolzt | |
| 7,506,495 | B2 * | 3/2009 | Cazzola | A44C 11/00 59/79.1 |
| 2003/0089128 | A1 | 5/2003 | Minassian | |
| 2005/0005637 | A1 | 1/2005 | Rapport | |
| 2006/0004252 | A1 | 1/2006 | Astala | |

OTHER PUBLICATIONS

PCT/US16/30768, International Search Report and Written Opinion, dated Sep. 8, 2016, 11 pages.

* cited by examiner

*Primary Examiner* — Jack W Lavinder
(74) *Attorney, Agent, or Firm* — Andrew F. Young, Esq.; Lackenbach Siegel LLP

(57) ABSTRACT

A bracelet and a method of assembling or manufacturing the same in which the bracelet includes a plurality of interlocking first and second bangles that are translatable relative one another such that the bracelet is transitionable between a first state and second state in which the bracelet has a diameter having a smaller dimension in the first state and a larger diameter in the second state, the bracelet being biased toward the first state.

11 Claims, 10 Drawing Sheets

EXPANDABLE BANGLE BRACELET

CROSS REFERENCE TO RELATED APPLICATIONS

This application relates to, and claims priority from Ser No. PCT/US2016/030768 filed May 4, 2016 the entire contents of which are incorporated herein by reference, which in turn claims priority from U.S. Prov. Ser. No. 62/161,151 filed May 13, 2015, the entire contents of which are incorporated herein by reference.

FIGURE SELECTED FOR PUBLICATION

FIG. 2A

BACKGROUND

Field of the Disclosure

The present disclosure generally relates to a bracelet, and more particularly, to an elastic bangle bracelet including a plurality of members that together form a ring shape having a diameter that is transitionable between a first dimension and a second dimension.

Description of the Related Art

A bracelet is an ornamental band that is worn on the wrist or arm. Sometimes, bracelets have a supportive function, such as holding a wristwatch or charms. Rigid bracelets, usually made from metal, wood, or plastic, are commonly referred to as bangle bracelets. Bracelets are generally sized to have a diameter that is at least as wide as the wrist but narrower than the remaining portion of the hand, such that when worn the distal portion of the hand tends to prevent the bracelet from slipping off the wrist.

The human wrist on which a bracelet is commonly worn is the proximal skeletal segment of the human hand. It is generally much narrower than the portion of the hand that extends distally from the wrist. Because wrists are generally narrower than the remaining portion of the hand, various ways of placing a bracelet on a wrist have been devised. These include bracelets that open such that they can be directly placed on the wrist and later closed. They also include bracelets that expand. For example, some bracelets are formed from elastic polymers that can be stretched over the distal end of the hand and then returned to its initial contracted state onto the wrist.

There is a continuing need for bracelets with aesthetic appeal that are expandable to both facilitate placement of the bracelet onto a wrist and to accommodate the different dimensions of human wrists.

SUMMARY OF THE PRESENT INVENTION

Disclosed herein are bangle bracelets and methods of assembling the same.

A bracelet may include a plurality of first and second bangles forming a circumference of the bracelet. The first and second bangles may be alternately positioned adjacent one another and translatable relative one another such that the bracelet may be transitioned between a first state in which the diameter of the bracelet has a first dimension and a second state in which the diameter of the bracelet has a second dimension. The first dimension may be less than the second dimension. The first and second bangles may have a curved shape such that the plurality of first and second bangles, when assembled, form a bracelet having a closed loop shape. The bangles may include assembly rings that are removably coupled thereto to facilitate grasping and handling of the bangles during assembly of the bracelet.

Each of the first and second bangles may be configured to interlock with one another such that the first and second bangles may form an assembly in which the bangles may translate relative one another such that the length of that assembly is adjustable. In particular, each of the first and second bangles may include a generally ovular base having a circumference, and a plurality of arm members positioned around the circumference of the base and extending lengthwise from the base. The arm members may be spaced apart from one another such that a gap or space is defined between adjacently positioned arm members. The arms of the first bangle may be configured to slide between and relative to the arms of the second bangle by translating through the gaps or spaces defined between the arms of the second bangle. Similarly, the arms of the second bangle may be configured to slide between and relative the arms of the first bangle by translating through the gaps or spaces defined between the arms of the first bangle. In that regard, when the first and second bangles are engaged with one another, the first and second bangles may be compressed in a direction toward one another to reduce the overall length of the assembly. Conversely, when an expansionary or stretching force is applied to the bangles to move them apart from one another, the overall length or circumference of the assembly may be increased such that the diameter of the bracelet is expanded. This stretching force may facilitate placement of the bracelet over one's hand onto the wrist.

A biasing force may urge the bracelet back to its resting or contracted state in which the diameter of the bracelet biased toward the resting or contracted state, such that the bracelet may comfortably fit upon the wrist and be blocked from slipping off the wrist by the person's hand. In particular, springs may be operatively coupled to the first and second bangles to provide a biasing force to urge the bracelet toward its resting state in which the bracelet is in a contracted state. A first cap having a shape corresponding to that of the first bangle and a second cap having a shape corresponding to that of the second bangle may be operatively coupled or secured to the first and second bangles to facilitate appropriate positioning of the springs relative to the bangles such that an appropriate biasing force is provided.

A method of assembling a bracelet may include providing a plurality of first and second bangles and assembling the bangles in an alternating pattern until the bracelet assembly is completed in which the bangles form a closed loop. In particular, a plurality of first bangles and a plurality of second bangles may be provided. The first and second bangles may in interlocked in a sliding relationship with one another by inserting the first arm members of the first bangles within the gaps defined between the second arm members of the second bangles and inserting the second arm members of the second bangles within the gaps defined between the first arm members of the first bangles. Springs may be operatively coupled to first and second bangles to bias the bracelet toward its resting state in which the bracelet is in a contracted state.

The above and other aspects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
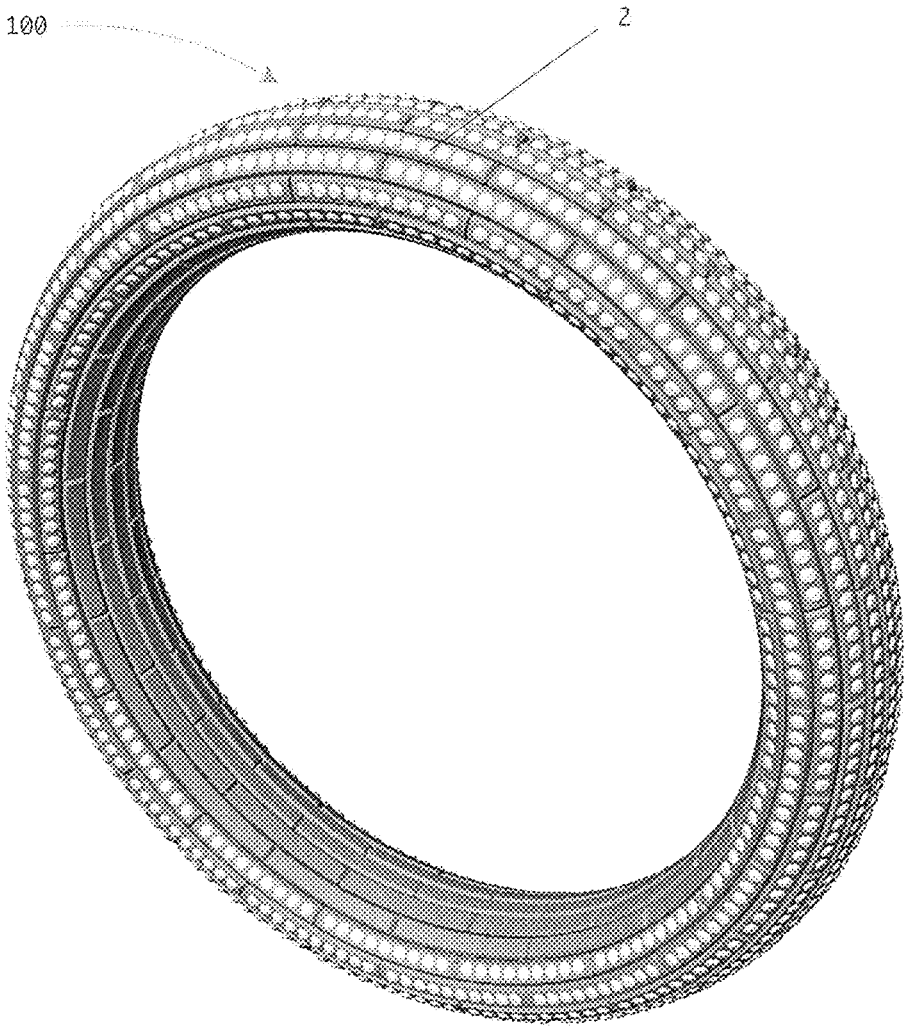
FIG. 1 is a perspective view of an assembled bracelet including a plurality of bangles in accordance with the present disclosure.

Reference will now be made in detail to embodiments of the disclosure. Wherever possible, same or similar reference numerals are used in the drawings and the description to refer to the same or like parts or steps. The drawings are in simplified form and are not to precise scale. The word 'couple' and similar terms do not necessarily denote direct and immediate connections, but also include connections through intermediate elements or devices. For purposes of convenience and clarity only, directional (up/down, etc.) or motional (forward/back, etc.) terms may be used with respect to the drawings. These and similar directional terms should not be construed to limit the scope in any manner. It will also be understood that other embodiments may be utilized without departing from the scope of the present invention, and that the detailed description is not to be taken in a limiting sense, and that elements may be differently positioned, or otherwise noted as in the appended claims without requirements of the written description being required thereto.

Various operations may be described as multiple discrete operations in turn, in a manner that may be helpful in understanding embodiments of the present invention; however, the order of description should not be construed to imply that these operations are order dependent.

Various embodiments of spreading devices are described herein with reference to FIGS. 1-12.

Figure 4A:
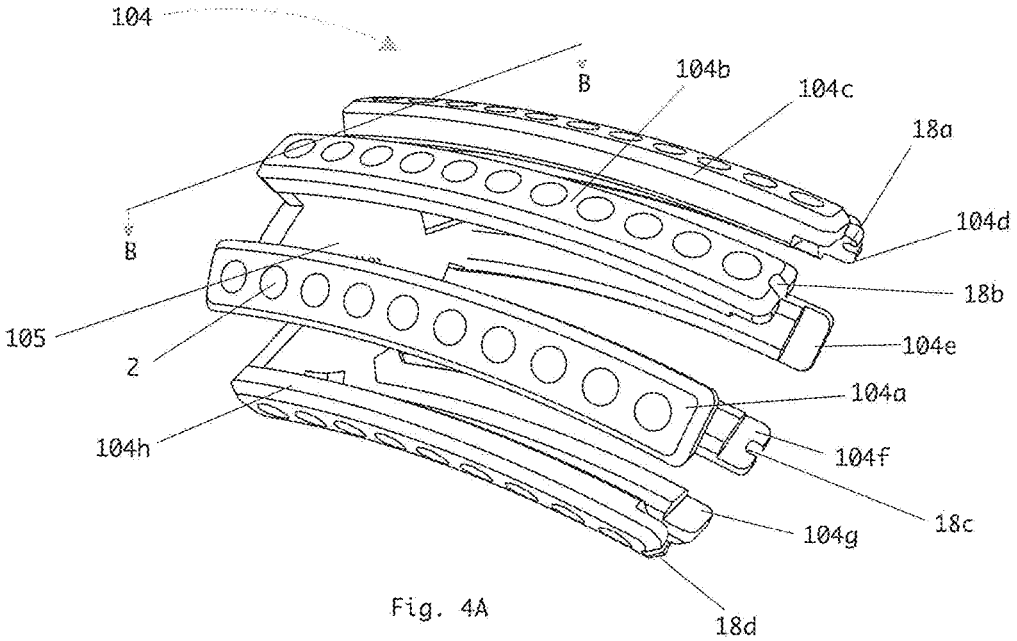
FIG. 4A is a perspective view of a second bangle.

As shown in FIG. 1, an assembled bracelet 100 including a plurality of bangles is depicted. The bracelet 100 may include a plurality of studs or jewels that are received within recesses or receptacles 2 formed within the bangles of bracelet 100. The bangles forming the bracelet 100 may include a plurality of first bangles 102 (FIG. 2A) and plurality of second bangles 104 (FIG. 4A). The bracelet 100 may have a generally circular shape and the first and second bangles 102, 104 may have a curvature that conforms to the circumference or perimeter of that shape such that the complete assembly of a number of bangles 102, 104 may result in a torodial or circular shaped bracelet. The bangles 102, 104 may be formed from any suitable material including, for example, metal, plastic, and/or wood.

Figure 2A:
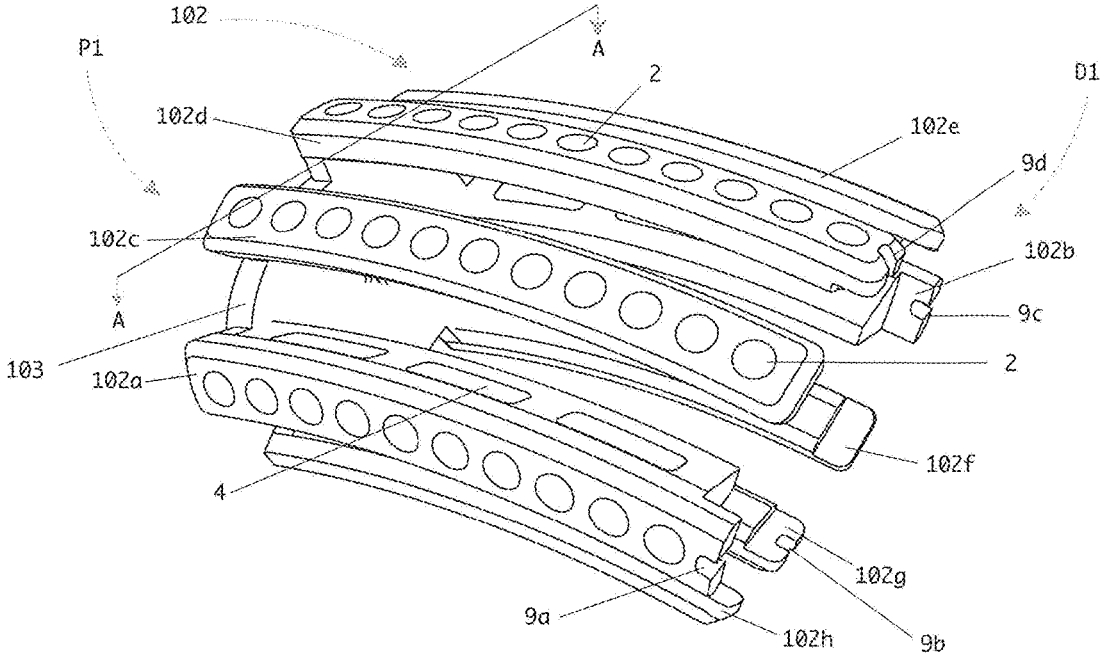
FIG. 2A is a perspective view of a first bangle.
Figure 2B:
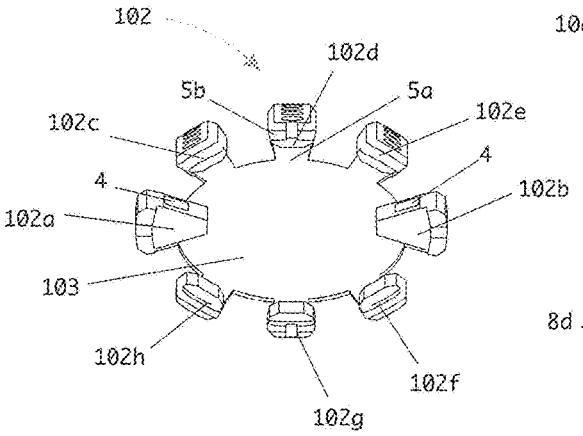
FIG. 2B is a perspective view of a foreshortened and tilted open-end view of the bangle of FIG. 2A taken as if looking toward line A-A.

As shown in FIG. 2A, a first bangle 102 may have a generally ovular cylindrical shape and may include a plurality of arms 102*a*-102*h* (e.g., eight arms) extending from a generally oval shaped base 103 at a proximal end "P" which is closed and a distal end "D1" that is open (prior to its being coupled to cap 10*a*). The arms 102*a*-102*h* may be formed by removing strips of material from the surface or circumference of the ovular cylindrical shape. The arms 102*a*-102*h* may be generally evenly spaced apart from one another and may be generally parallel to one another. Some or all of the arms 102*a*-102*h* may have receptacles 2 formed therein for the reception of studs or gemstones, for example. Some or all of the arms 102*a*-102*h* may also include one or more cut-out portions or vents 4, which may extend through the width of each arm. The vents 4 may reduce weight and may facilitate translation of the arms 102*a*-102*h* relative to the arms of another bangle to which the bangle 102 is operatively coupled. As shown in FIGS. 2A-2B, only the arms 102*a* and 102*b* include the vents 4. However, the other remaining arms 102*c*-102*h* may include such vents as well. The vents 4 may inhibit any air blockage that might otherwise impede the translation or movement of the bangle 102 in the absence of such vents.

The shape and spacing of the arms 102*a*-102*h* may be better appreciated in FIG. 2B, which is a cutaway perspective view of a portion of the first bangle 102. As shown in FIG. 2B, the arms 102*a*-102*h* extend radially from the ovalular base 103 and are substantially equidistantly spaced apart from one another such a gap or space is formed between each pair of adjacently positioned arms 102*a*-102*h*. As shown best in FIG. 2B, eight gaps or spaces may be formed between the arms 102*a*-102*h*. The portions of the arms 102*a*-102*h* that are closer to the perimeter or outer surface of the bangle 102 may be wider than the portions of the arms nearer to the ovular base 103. Arm members 102*a* and 102*b* may be generally triangular or trapezoidal shaped. Arm members 102*c*-102*h* may be generally mushroom shaped, that is with a base section 5*a* of a generally uniform width and an upper section 5*b* that is generally wider than the base section 5*a*.

Figure 3:
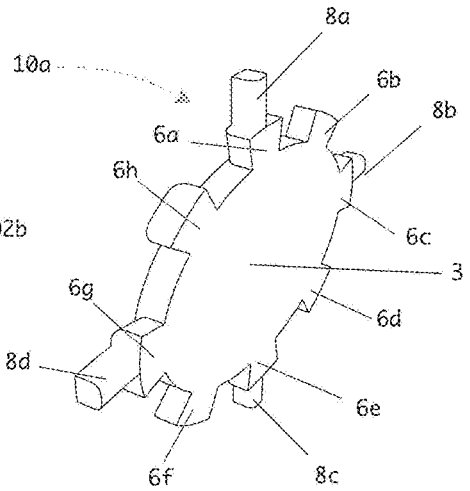
FIG. 3 is a perspective view of a first cap.

As shown in FIG. 3, a cap 10*a* may have a shape that corresponds to the shape of the bangle 102 such that the cap 10*a* may be coupled to an end of the bangle 102 without blocking or obstructing the gaps or spaces defined between the arms 102*a-h* of the bangle 102. In other words, the cap 10*a* may be configured to cap or close off the center of the bangle 102 while still allowing or permitting the arms 104*a-h* of the second bangle 104 to translate through the spaces or gaps defined between the arms 102*a-h* of the first bangle.

In particular, the cap 10*a* may have a generally ovular shape with fingers 6*a*-6*h* extending from its ovular shaped core 3. The fingers 6*a*-6*h* may be sized and spaced such that each of the fingers 6*a*-6*h* may fit between and move through the gaps or spaces defined between the arms 102*a*-102*h*. Protrusions 8*a*-8*d* may extend from one or more of the fingers 6*a*-6*h*, and the protrusions 8*a*-8*d* may be configured to be received within receptacles 9*a*-9*d* of the bangle 102 such that the engagement between the protrusions 8*a*-8*d* and the receptacles 9*a*-9*d* impede or prevent continued translation of the cap 10*a* through the bangle 102. The protrusions 8*a*-8*d* may be snapped into place within the receptacles 9*a*-9*d*. In other words, the protrusions 8*a*-8*d* may form an interference fit or be press fit or friction fit with the receptacles 9*a*-9*d*. The fingers 6*b*, 6*d*, 6*f*, and 6*h* that lack protrusions 8*a-d* may include a lip or edge that is each configured to engage an arm of the first bangle 102 to facilitate holding the cap 10*a* in place relative to the bangle 102.

As shown in FIG. 3, a first protrusion 8*a* may extend from the finger 6*a* of the cap 10*a*, a second protrusion 8*b* may extend from the finger 6*c* of the cap 10*a*, a third protrusion 8*c* may extend from the finger 6*e*, and a fourth protrusion 8*d* may extend from the finger 6*g*. Each of these protrusions 8*a*-8*d* may be configured to be received by the receptacles 8*a*-8*d*. Referring back to FIG. 2A, arm 102*a* may include the receptacle 9*a* at a distal end thereof, arm 102*g* may include the receptacle 9*b* at a distal end thereof, arm 102*b* may include the receptacle 9*c* at a distal end thereof, and arm 102*d* may include the receptacle 9*d* at a distal end thereof.

As shown in FIG. 4A, a second bangle 104 may have a generally ovular cylindrical shape and may include a plurality of arms 104*a*-104*h* (e.g., eight arms) extending from a generally oval shaped base 105. The arms 104*a*-104*h* may be formed by removing strips of material from the surface or circumference of the ovular cylindrical shape. The arms 104*a*-104*h* may be generally evenly spaced apart from one another and may be generally parallel to one another. Some or all of the arms may have receptacles 2 formed therein for the reception of studs or gemstones, for example.

In addition, similar to the structure of first bangle 102 and the first cap 10*a* described herein, the arms 104*b*, 104*d*, 104*g* and 104*h* of the second bangle 104 may include receptacles 18*a-d* respectively that are configured to engage and be secured to fingers 16*a-d* respectively of a second cap 10*b* (FIG. 5), for example, via spot soldering or welding, to form a unitary structure such that movement of the second bangle 104 would result in a corresponding movement of the second cap 10*b*.

Figure 4B:
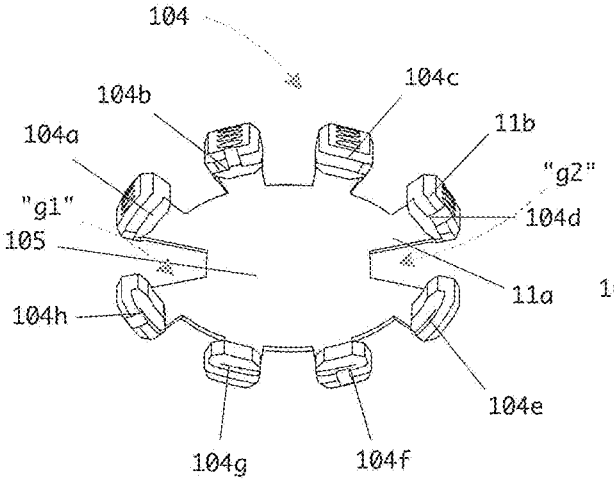
FIG. 4B is a perspective view of a foreshortened and tilted open-end view of the bangle of FIG. 4A taken as if looking toward line B-B.

The shape and spacing of the arms 104*a*-104*h* may be better appreciated in FIG. 4B, which is a cutaway perspective view of a portion of the second bangle 104. As shown in FIG. 4B, the arms 104*a*-104*h* may extend radially from the generally ovular base 105, and may be substantially equidistantly spaced apart from one another such that a gap or space is formed between each pair of adjacently positioned arms 104*a*-104*h*. As shown best in FIG. 4B, a gap or space may be formed between each pair of adjacent arms 104*a*-104*h* such that eight gaps or spaces are defined between the arms. The portions of the arms 104*a*-104*h* that form nearer to exterior surface or perimeter of the bangle 104 may be wider than the portions of the arms that are nearer to the ovular base 105. In particular, each of the arms 103*a*-104*h* may include a base section 11*a* and an upper portion 11*b* that is wider than the base section 11*a*. The adjacent arms 104*a* and 104*h* may include a gap "g1" therebetween, and the adjacent arms 104*d* and 104*e* may include a gap "g2" therebetween. The gaps "g1" and "g2" may be configured to receive the generally triangular or trapezoidal shaped arms 102*a* and 102*b* of the first bangle 102. Moreover, the arms 102*a-h* of the first bangle 102 and the arms 104*a-h* of the second bangle 104 may be configured, e.g., dimensioned and shaped, to enable and facilitate the arms of each the respective bangles 102, 104 to be received in the gaps or spaces of the other bangle 102, 104 such that the bangles 102, 104 may be coupled to and translated relative to one another.

Figure 5:
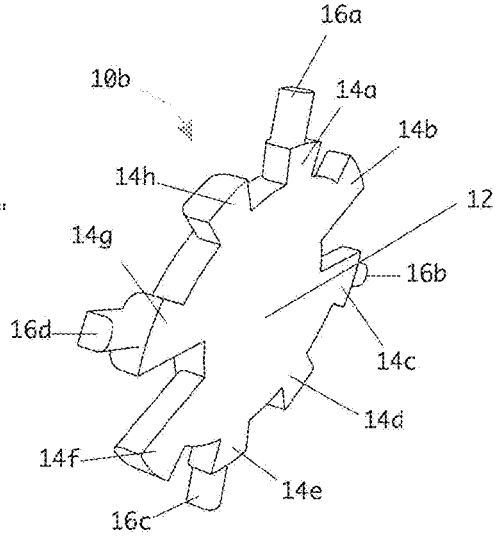
FIG. 5 is a perspective view of a second cap.

A second cap 10*b* is shown in FIG. 5. The second cap 10*b* may have a shape that corresponds to the shape of the bangle 104 such that the cap 10*b* may be operatively coupled to an end of the bangle 104 without blocking or obstructing the reception of arms 102*a-h* of the bangle 102 through the gaps or spaces defined between the arms 104*a-h* of the bangle 104. In particular, the cap 10*b* may include a generally oval shaped core 12 and fingers 14*a*-14*h* may extend radially from the cap 10*b*. Protrusions 16*a-d* may extend from fingers 14*a*, 14*c*, 14*e*, and 14*g* respectively. The cap 10*b* may be secured to an end of the second bangle 102.

Both the first and second bangles 102, 104 have generally hollow interiors in which biasing members, e.g., springs 20 may be secured. The first and second caps 10*a*, 10*b* may be secured, e.g., via spot soldering, at the midpoints of the first and second bangles 102, 104 respectively with the springs 20 positioned adjacent to each cap 10*a*, 10*b*. The springs 20 may be secured, e.g., spot soldered or fastened, to the caps 10*a*, 10*b* or to the bangles 102, 104 such that movement of the interlocking bangles 102, 104 relative to one another may result in a tensioning or stretching of the springs 20 such that the bracelet 100 is biased toward its at rest or contracted state, i.e., non-expanded state. Alternatively, when assembled with the first and second bangles 102 and 104 in an interlocking alternating arrangement, the springs 20 may be free within the space defined between the first caps 10*a* and closed ends of the second bangles 104 and within the space defined between the second caps 10*b* and the closed ends of the first bangles 102 such that relative movement of the first and second bangles 102, 104 may compress the springs 20 therebetween to resist the relative movement of the first and second bangles 102, 104 in a direction that would lengthen the assembly.

A method of assembling the bracelet 100 will now be described with reference to FIGS. 6-12. Each of the first and second bangles 102, 104 may include an assembly ring 30 that is coupled to the circumference or perimeter of the bangles. The assembly ring 30 may facilitate grasping or holding of the bangles 102, 104 during the assembly of the bracelet 100.

Figure 6:
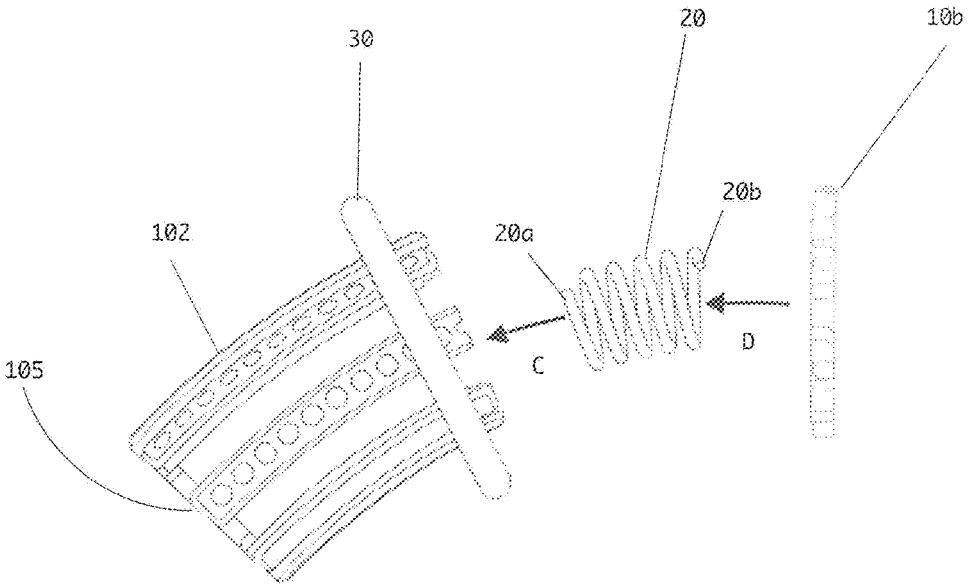
FIG. 6 illustrates a first step in the assembly of the bracelet of FIG. 1 showing the bangle of FIG. 2A relative to a spring and the first cap of FIG. 3.
Figure 7:
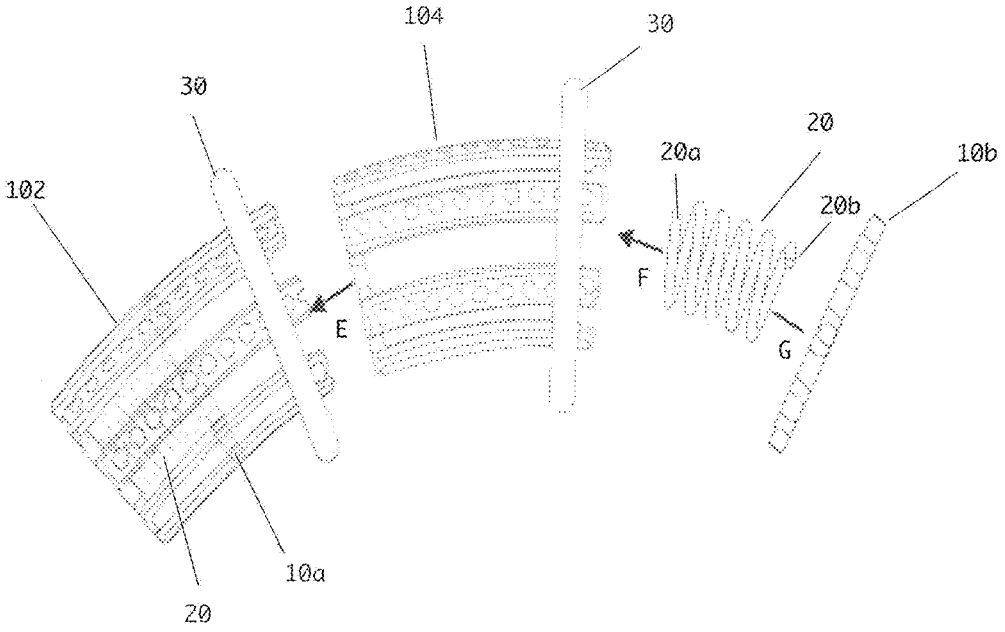
FIG. 7 illustrates a second step in the assembly of the bracelet of FIG. 1 showing an assembled portion including the first bangle of FIG. 2A including the spring and first cap placed therein shown relative to another spring and the second cap of FIG. 5.

As shown in FIG. 6, the first bangle 102 is shown relative a spring 20, and a the first cap 10*b*. As indicated by directional arrow C, the spring 20 is placed within the first bangle 102, and as indicated by directional arrow D, the first cap 10*b* is then placed within the first bangle 102. The spring 20 may provide a tensioning force such that it resists expansion. A first end 20*a* of the spring 20 may be secured, e.g., soldered, to the base 105 and a second end 20*b* of the spring 20 may be secured to the cap 10*b*. As shown in FIG. 7, once the spring 20 and the second cap 10*b* are positioned within the first bangle 102, the fingers of the second cap 10*b* are disposed within the gaps or spaces defined between the arms 102*a*-102*h* such that the second cap 10*b* is translatable through and along the length of the first bangle 102.

As shown in FIG. 7, the second bangle 104 is then translated along directional arrow E relative to the first bangle 102 such that the arms 102*a-h* of the first bangle 102 are received within the gaps or spaces defined between the arms 104*a-h* of the second bangle 104, and the arms 104*a-h* of the second bangle 104 are received within the gaps or spaces defined between the arms 102*a-h* of the first bangle 102. Another spring 20 may then be positioned within the second bangle 104 by translating the spring 20 therethrough as indicated by directional arrow F, and the second cap 10*b* may then be placed within the bangle 104 by translating the cap 10*a* therethrough as indicated by the directional arrow G. The cap 10*a* may then be secured to the first bangle 102 by securing the protrusions 8*a*-8*d* to respective receptacles 9*a*-9*d* of the corresponding arms 102*a*, 102*g*, 102*b*, and 102*d*, respectively.

Figure 8:
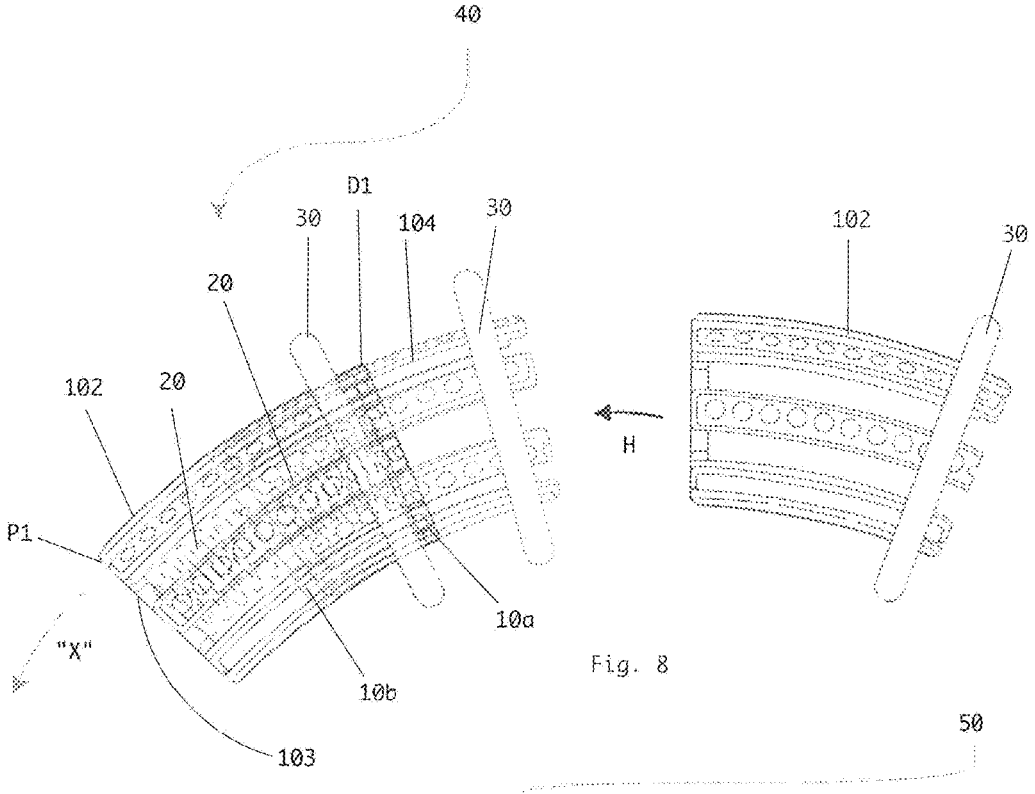
FIG. 8 illustrates a third step in the assembly of the bracelet of FIG. 1 showing an assembled portion including the first bangle of FIG. 2A and the second bangle of FIG. 4A shown relative to another first bangle of FIG. 2A.

Once this step is completed, as shown in FIG. 8, the assembled portion 40 of the bracelet 100 includes the first cap 10*a* is secured to the first bangle 102 at the distal end "D1" thereof, the second cap 10*b* is positioned between the distal end "D1" and the proximal end "P1" of the first bangle 102. The second cap 10*b* is positioned between a first spring 20, which is positioned between the base 103 and the cap 10*b*, and a second spring 20, which is positioned between the distal end "D1" and the cap 10*b*. In its rest position, the assembled portion 40 is substantially as shown in FIG. 8. When the first bangle 102 is translated along directional arrow "X", namely out from the second bangle 104, the spring 20 that is positioned between the cap 10*b* and the base 103 of the first bangle 102 is compressed and resists the movement. The spring 20 that is positioned between the proximal end P1 of the first bangle 102 and the second cap 10*b* maintains the relative positioning of the first and second bangles 102, 104 when at rest such that the assembled portion 40 may be coupled to additional bangles during the assembly of the bracelet 100. In particular, the spring 20 that is between the base 103 and the cap 10*b* inhibits further translation of the bangles 102, 104 relative to one another such that portions of the gaps or spaces between the arms 102*a-h* and the arms 104*a-h* of the respective bangles 102, 104 remain free to engage and receive additional bangles.

Figure 8A:
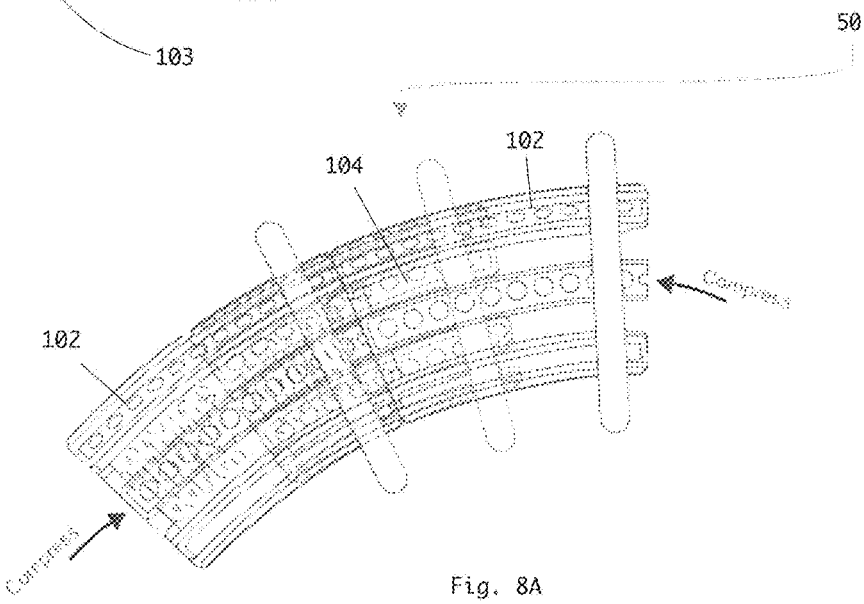
FIG. 8A is a front view of a partially assembled portion of the bracelet of FIG. 1 after the third step of FIG. 8.

Thereafter, as shown in FIG. 8, another first bangle 102 may be coupled to the assembled portion 40 by translating the additional first bangle 102 in the direction of arrow H toward the assembled portion 40 such that the arms 102*a-h* of this first bangle 102 may engage the arms 104*a-h* of the second bangle 104 of the assembled portion 40. Thereafter, as shown in FIG. 8A, a partially assembled portion 50 of the bracelet 100 is formed. The ends of the portion 50 may be compressed by holding and pressing the ends toward each other as shown in FIG. 8A.

Figure 9B:
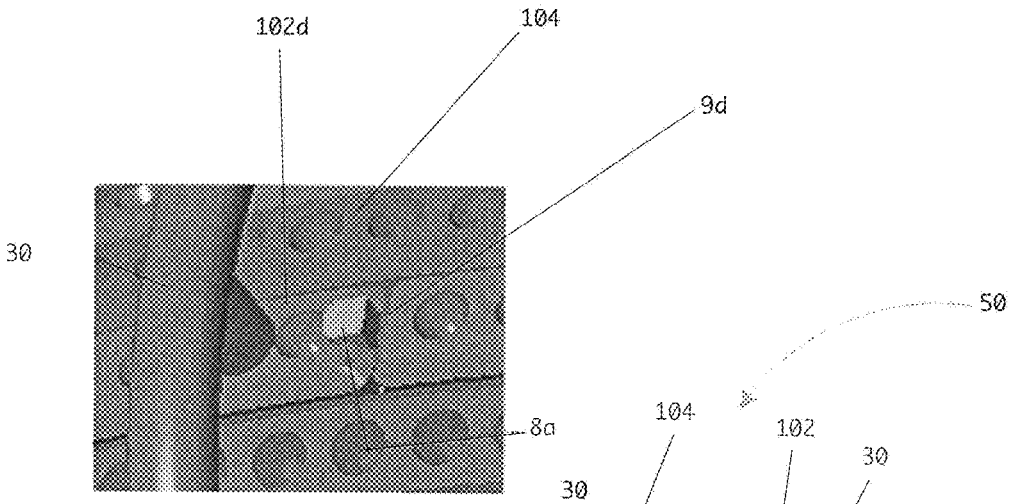
FIG. 9B is an enlarged view of the indicated area of FIG. 9A illustrating a fourth step in the assembly of the bracelet of FIG. 1.
Figure 9A:
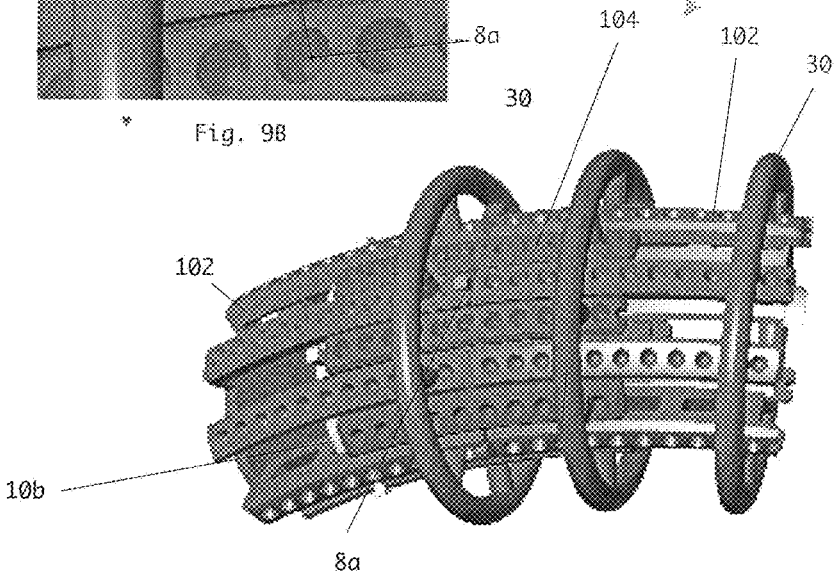
FIG. 9A illustrates an assembled portion of the bracelet after the third step of FIG. 8.
Figure 9C:
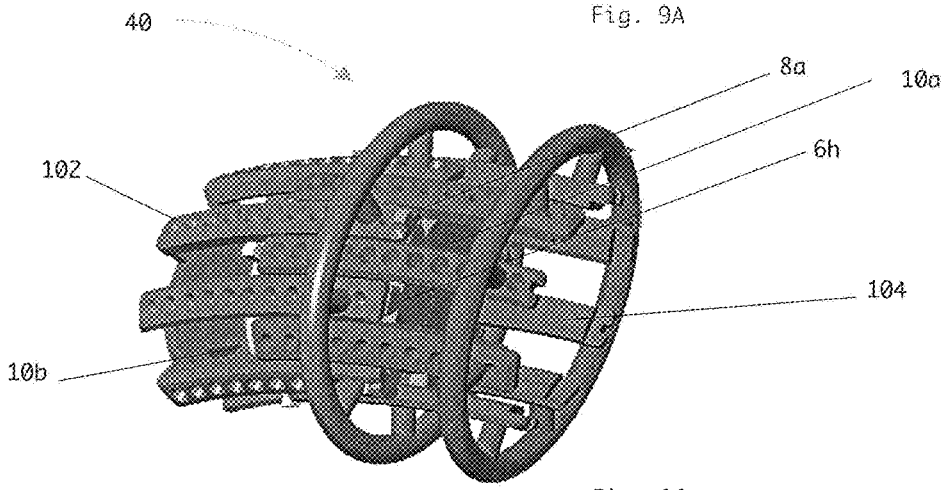
FIG. 9C is a perspective view of a partially assembled portion of the bracelet after the completion of the fourth step of FIG. 9B.

Once the portion 50 is in the compressed condition, the first cap 10*a* may be permanently secured in its position, as shown in FIG. 9A. Referring to FIG. 9B, which is an enlarged section of the portion 50, the cap 10*a* may be secured to one of the first bangles 102 by soldering, for example, the protrusions 8*a-d* to the respective arms of the first bangle 102 to which the corresponding protrusions are coupled. As shown in FIG. 9B, the protrusion 8*a* is secured, for example via soldering, within the receptacle 9*d* of the arm 102*d* of the first bangle 102. Thereafter, as shown in FIG. 9C, the additional first bangle 102 that was added in step 8 may be removed to facilitate access to the first cap 10*a* such that securing of the first cap to the first bangle 102 may be completed. In particular, the remaining fingers that lack protrusions 8*a-d*, namely fingers 6*b*, 6*d*, 6*f*, and 6*h* may be secured, e.g., soldered, to the respective arms of the first bangle 102 in which they are in contact. Thereafter, the additional first bangle 102 that was introduced in the step described with respect to FIG. 8, and was subsequently removed as shown in FIG. 9C, is once again added to the assembled link or portion of the bracelet. This partially assembled link or portion is shown in FIG. 10 relative to a spring 20 and a second cap 10*b*.

Figure 10:
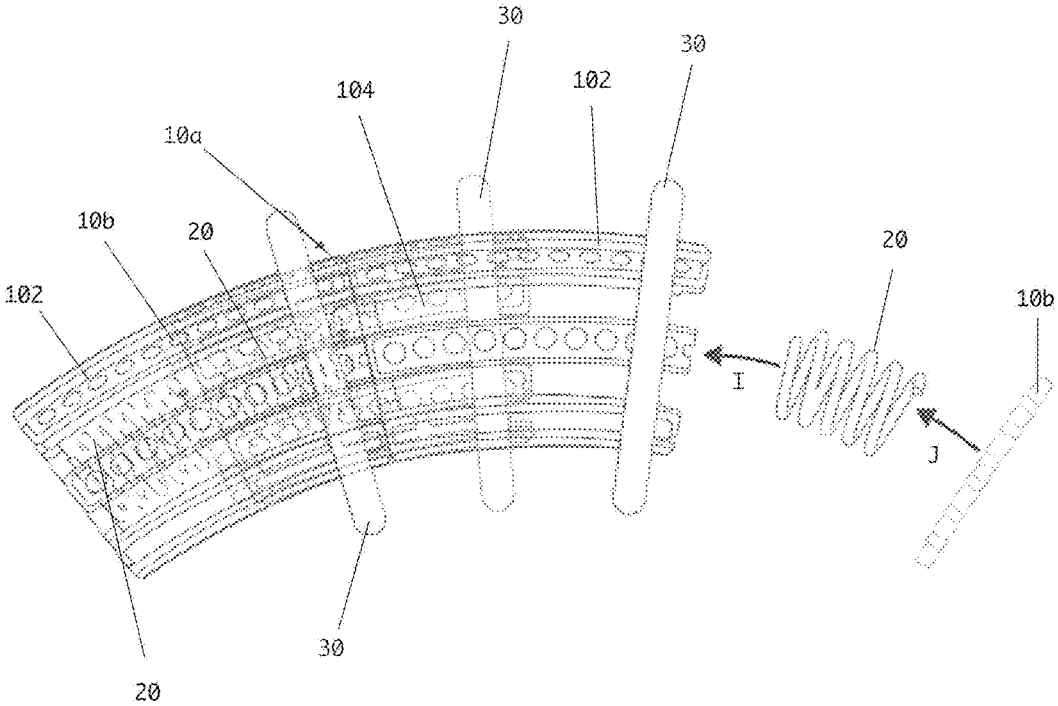
FIG. 10 illustrates a fourth step in the assembly of the bracelet of FIG. 1.
Figure 11:
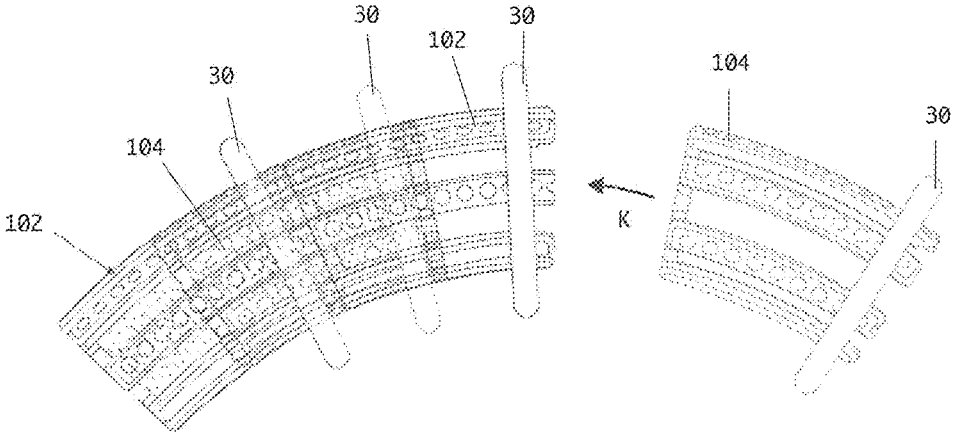
FIG. 11 illustrates a fifth step in the assembly of the bracelet of FIG. 1 showing a second bangle as shown in FIG. 4A relative to an assembled portion of the bracelet of FIG. 1.

Thereafter, as shown in FIG. 10, another spring 20 and another second cap 10*b* may be added to the assembly. In particular, as shown in FIG. 10, spring 20 is moved in the direction of arrow I and placed within the assembly. Similarly, cap 10*b* is placed within the assembly by moving it in the direction of arrow J into the interior of the assembly. Thereafter, as shown in FIG. 11, a second bangle 104 is added to the assembly by translating it in the direction of arrow K such that the second bangle 104 may engage a first bangle 102 of the assembly.

Figure 12:
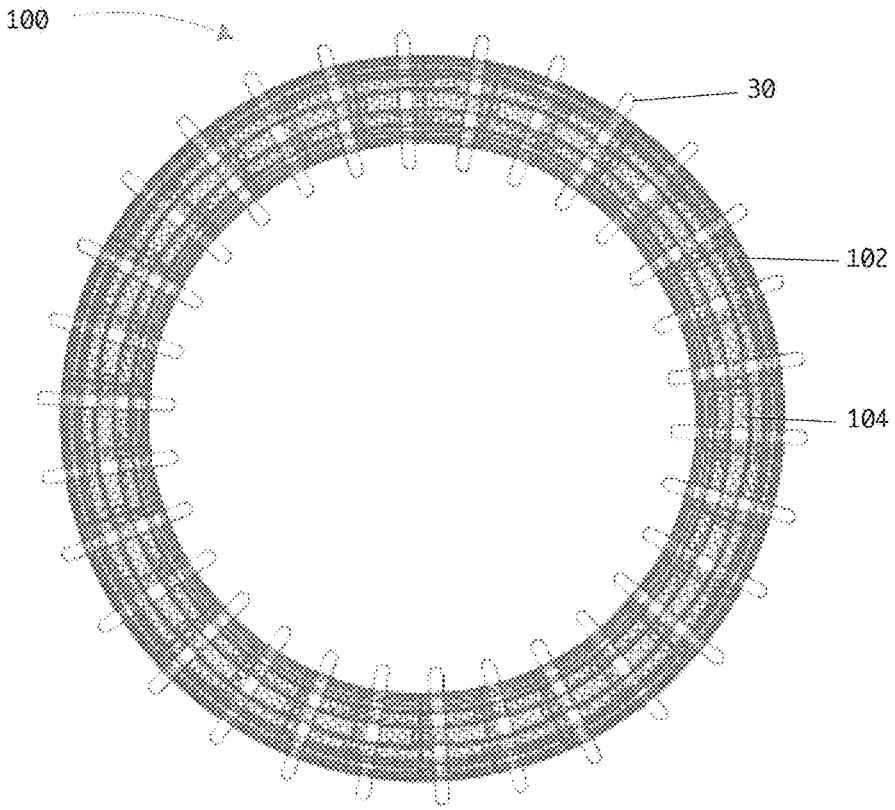
FIG. 12 illustrates the assembled bangle of FIG. 1 shown coupled to a plurality of assembly rings.

The steps described hereinabove are repeated until all the bangles 102, 104 forming the bracelet 100 in an alternating pattern form the completed bracelet 100, as shown in FIG. 12. As shown best in FIG. 12, the total number of bangles 102, 104 may be equal to thirty (30). However, depending on the size of the bangles a greater or lesser number of bangles may be used. As shown in FIG. 13, the alignment of the alternating bangles 102, 104 may be tested. In particular, after completing the assembly as shown in FIG. 12, each pair of adjacent bangles 102, 104 preferably extend to approximately the midpoint of one another. The tolerances, e.g., alignment and gaps, between each of the bangles 102, 104 may be checked. Thereafter, the assembly rings 30 may be removed, e.g., cut, away from the bangles 102, 104 to which they are coupled or attached, and the bracelet 100 is complete.

During use, a person may expand the diameter of the bracelet 100 by pulling the ends of the bracelet 100 such that the springs 20 within the bangles 102, 104 are stretched. The expansion of the diameter of the bracelet 100 facilitates placement of the bracelet 100 upon the wrist of the person. When the pulling force applied to the bracelet 100 is released, the springs 20 urge the bracelet 100 to transition back to its initial, at rest condition. In the resting position, the gaps or spaces between the bangles 102, 104 is minimal and the bracelet 100 may have the appearance of a unitary structure.

Having described at least one of the preferred embodiments of the present disclosure with reference to the accompanying drawings, it will be apparent to those skills that the invention is not limited to those precise embodiments, and that various modifications and variations can be made in the presently disclosed system without departing from the scope or spirit of the invention. Thus, it is intended that the present disclosure cover modifications and variations of this disclosure provided they come within the scope of the appended claims and their equivalents.

What is claimed is:

1. A bracelet, comprising:

a plurality of first and second bangles forming a circumference of the bracelet, the bracelet having a at least one diameter, the first and second bangles being alternately positioned adjacent to one another, adjacently positioned first and second bangles being translatable relative to one another such that the bracelet is transitionable between a first state in which the diameter has a first dimension and a second state in which the diameter has a second dimension, the second dimensions being greater than the first dimension, wherein each of the first bangles has a curved shape and comprises:

an ovular base having a circumference; and a plurality of first arm members positioned around the circumference of the base and extending lengthwise from the base, the first arm members being spaced apart from one another around the circumference of the base such that a gap is defined between adjacently positioned first arm members, and wherein each of the second bangles has a curved shape and comprises:

an ovular base having a circumference; and a plurality of second arm members positioned around the circumference of the base and extending lengthwise from the base, the second arm members being spaced apart from one another around the circumference of the base such that a gap is defined between adjacently positioned second arm members, and wherein each of the first arm members of the first bangle are configured to be received and translated through the gaps defined between adjacent ones of the second arm members of the second bangles, and wherein each of the second arm members of the second bangle are configured to be received and translated through the gaps defined between adjacent ones of the first arm members of the first bangles; and further comprising assembly rings that are removably coupled to each of the first and second bangles, each ring being disposed around the perimeter of the bangles.

2. A bracelet, comprising:

a plurality of first and second bangles forming a circumference of the bracelet, the bracelet having a at least one diameter, the first and second bangles being alternately positioned adjacent to one another, adjacently positioned first and second bangles being translatable relative to one another such that the bracelet is transitionable between a first state in which the diameter has a first dimension and a second state in which the diameter has a second dimension, the second dimensions being greater than the first dimension, wherein each of the first bangles has a curved shape and comprises:

an ovular base having a circumference; and a plurality of first arm members positioned around the circumference of the base and extending lengthwise from the base, the first arm members being spaced apart from one another around the circumference of the base such that a gap is defined between adjacently positioned first arm members, and wherein each of the second bangles has a curved shape and comprises:

an ovular base having a circumference; and a plurality of second arm members positioned around the circumference of the base and extending lengthwise from the base, the second arm members being spaced apart from one another around the circumference of the base such that a gap is defined between adjacently positioned second arm members, and wherein each of the first arm members of the first bangle are configured to be received and translated through the gaps defined between adjacent ones of the second arm members of the second bangles, and wherein each of the second arm members of the second bangle are configured to be received and translated through the gaps defined between adjacent ones of the first arm members of the first bangles;

a plurality of first caps that are secured to an end of each first bangle, a plurality of second caps that are secured to an end of each second bangle, the first cap having a shape corresponding to the shape of the first bangle, the second cap having a shape corresponding to the shape of the second bangle; and wherein at least some of the arms of the first bangle include a first receptacle, and wherein the first cap includes at least one protrusion, the protrusion configured to be securely received by the first receptacle.

3. A method of assembling a bracelet, comprising:

providing a plurality of first bangles, each first bangle comprising:

an ovular base having a circumference;

a plurality of first arm members positioned around the circumference of the base and extending lengthwise from the base, the first arm members being spaced apart from one another around the circumference of the base such that a gap is defined between adjacently positioned first arm members;

providing a plurality of second bangles, each second bangle comprising:

an ovular base having a circumference; and a plurality of second arm members positioned around the circumference of the base and extending lengthwise from the base, the second arm members being spaced apart from one another around the circumference of the base such that a gap is defined between adjacently positioned second arm members; and interlocking the first and second bangles in a sliding relationship with one another by inserting the first arm members of the first bangles within the gaps defined between the second arm members of the second bangles and inserting the second arm members of the second bangles within the gaps defined between the first arm members of the first bangles.

4. The method of claim 3, further comprising:

providing a plurality of spring elements;

operatively coupling the spring elements to the first and second bangles such that the spring elements provide a biasing force urging the first and second bangles toward a compressed position relative one another.

5. The method of claim 3, further comprising:

providing a first cap having a shape corresponding to that of the first bangle, a second cap corresponding to that of the second bangle, and a first spring element;

forming a partial assembly of the bracelet by:

placing the spring element within one of the first bangles;

translating the second cap through the one of the first bangles such that it is positioned at an approximate midpoint of the one of the first bangles;

translating one of the second bangles through the one of the first bangles such that the first bangle is positioned at an approximate midpoint of a length of the second bangle and the second bangle is positioned at an approximate midpoint of a length of the first bangle;

placing a second spring element through the first and second bangles such that it contacts the second cap;

placing the first cap through the first and second bangles such that it contacts the second spring element such that it is positioned at an approximate midpoint of the one of the second bangles;

adding alternating first and second bangles to the partial assembly as provided in the step of forming a partial assembly of the bracelet until the assembly is completed such that the bracelet forms a closed looped of alternating first and second bangles.

6. The method of claim 5, wherein the first cap is permanently secured to the first bangle.

7. The method of claim 6, wherein the first cap is spot soldered to the first bangle.

8. The method of claim 3, wherein each of the first and second bangles includes an assembly ring removably coupled to a perimeter of the first and second bangles, and wherein during placement of the first and second bangles relative to one another the first and second bangles are moved by grasping and moving the assembly rings.

9. The method of claim 8, further comprising removing the assembly rings after completing placement of the first and second bangles in an alternating pattern in which the first and second bangles form a closed loop forming the bracelet.

10. The method of claim 9, wherein receptacles are formed within surfaces of the first and second bangles, and further comprising securing gemstones within the receptacles.

11. The method of claim 5, wherein the partial assembly is compressed and at least one of the first caps is spot soldered to a midpoint along a length of at least one of the first bangles.

* * * * *